United States Patent [19]

Cartwright

[11] 4,367,984

[45] Jan. 11, 1983

[54] STABILIZATION OF PARTICULATE MATERIAL

[76] Inventor: Frederick D. Cartwright, 506 Lake Club Apartments, Lake Rd., Germiston, Transvaal, South Africa

[21] Appl. No.: 157,309

[22] Filed: Jun. 9, 1980

[30] Foreign Application Priority Data

Jun. 13, 1979 [ZA] South Africa ..... 79/2917

[51] Int. Cl.[3] ..... E02D 3/12

[52] U.S. Cl. ..... 405/258; 405/15; 47/25

[58] Field of Search ..... 405/258, 263, 265, 266, 405/15, 34–41, 270, 264, 128; 47/27, 25, 30, 9

[56] References Cited

U.S. PATENT DOCUMENTS

| | | | |
|---|---|---|---|
| 647,322 | 4/1900 | Newburg | 405/16 |
| 1,554,865 | 9/1925 | Magoon | 47/25 X |
| 1,905,176 | 4/1933 | Kieckhefer | 405/15 X |
| 2,061,631 | 11/1936 | Law | 47/30 |
| 2,318,349 | 5/1943 | Wiley | 405/15 |
| 2,784,528 | 3/1957 | Rudenauer | 47/30 X |
| 3,005,287 | 10/1961 | Dudley | 405/36 X |
| 3,287,851 | 11/1966 | Cramer | 47/25 |
| 3,667,178 | 6/1972 | Algers | 405/229 X |
| 3,705,467 | 12/1972 | McKnight | 405/264 X |
| 3,797,253 | 3/1974 | Rodieck | 405/37 |
| 4,067,197 | 1/1978 | Ritter | 405/258 |
| 4,219,941 | 9/1980 | Hair | 405/258 |

*Primary Examiner*—Dennis L. Taylor
*Attorney, Agent, or Firm*—Pasquale A. Razzano

[57] ABSTRACT

This invention relates to a method of and apparatus for stabilizing the surface layer of particulate material which is exposed to the elements with the apparatus consisting of dam members which each include sheet material which is formed into an enclosure which may have a plurality of compartments all of which are open top and bottom and the method includes the steps of locating the dam members on or slightly in the particulate material and placing a suitable liquid stabilizing medium in the dam member or its compartments, and allowing the liquid to permeate the zone of particulate material enclosed by the dam member.

5 Claims, 4 Drawing Figures

STABILIZATION OF PARTICULATE MATERIAL

FIELD OF THE INVENTION

This invention relates to a method of and apparatus for stabilising particulate material and particularly the surface material of mine dumps, sand dunes and other permanent or semi-permanent areas of particulate material.

BACKGROUND OF THE INVENTION

Methods of stabilising particulate material exist. The most popular method of mine dump, sand dune and sloping earth embankment stabilisation consists in covering at least the sloping sides of whatever is to be stabilised with vegetation. This is, however, an extremely costly process as the material to be stabilised has to be suitably prepared to accept the vegetation and the cost of maintaining the vegetation when established is high. Another method of stabilising particulate material is to saturate the surface layer of the material with a liquid binding agent which causes the surface particles to adhere to each other. The binding agent is generally sprayed onto the surface to be treated. This method of application of the binding agent to flat or nearly flat surfaces works fairly well but problems arise when the surface to be treated slopes and the rate of liquid run-off exceeds the absorption rate of the material being treated. Obviously, the seriousness of this problem increases with an increase in the angle of the sloping surface and is particularly severe on mine dumps which slope at angles above 30°.

OBJECT OF THE INVENTION

It is the object of this invention to provide a method of and apparatus for stabilising particulate material which will minimise the problems mentioned above.

SUMMARY OF THE INVENTION

A method of stabilising particulate material according to the invention includes the steps of providing dams on the surface, placing a liquid stabilising medium in the dams and allowing the liquid in the dams to permeate the surface of the material. Preferably, the method includes the step of loosening the surface of the particulate material to a predetermined depth to facilitate permeation of the surface material by the liquid stabilising medium.

If the surface of the material to be stabilised slopes the dams could be provided by embedding sheet material on edge in the particulate material at spaced intervals across the slope of the material. Preferably, the embedded sheet material extends above the surface of the particulate material so that the liquid stabilising medium is dammed above and below the surface of the material.

Apparatus for use in stabilising a surface layer of particulate material according to the invention includes a dam member which includes a dam wall which is made from sheet material and means for holding the wall member substantially perpendicular to the surface of the material across the slope to prevent run-off of the liquid placed in the dam member.

According to the invention there is provided apparatus for use in stabilising a surface layer of particulate material comprising a dam member which is adapted for location on the surface of the material and which includes at least one compartment which is open top and bottom with the elements of the dam member which define the walls of the or each compartment being adapted to dam liquid placed in the compartment.

Preferably, the dam member includes a continuous wall of sheet material which defines an enclosure and a plurality of members which extend across the enclosure to define the walls of the compartments and dam liquid placed in the compartments.

Preferably, the dam member includes a continuous wall of sheet material which defines an enclosure and a plurality of substantially parallel members which extend across the enclosure to define the walls of the compartments.

BRIEF DESCRIPTION OF THE DRAWINGS

The invention will now be described by way of example with reference to the drawings in which.

DETAILED DESCRIPTION OF THE PREFERRED EMBODIMENTS

Figure 1:
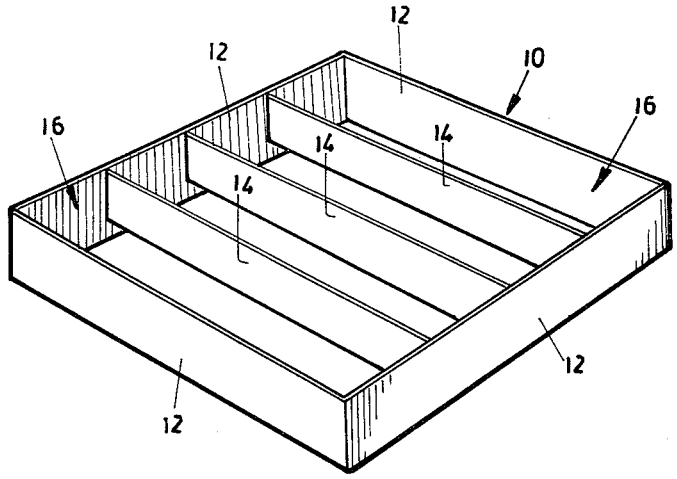
FIG. 1 is a perspective view of one embodiment of the apparatus of the invention.
Figure 2:
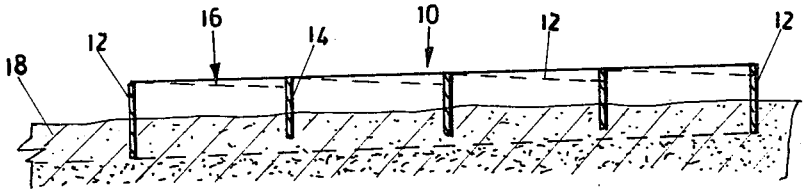
FIG. 2 is a sectional side elevation of the apparatus of FIG. 1 in use.

One form of the apparatus of the invention is shown in FIGS. 1 and 2 of the drawings to consist of a dam member 10 which is made from rigid sheet metal and includes vertical side walls 12 and partitioning elements 14 which divide the space enclosed by the walls 12 into four compartments 16 which are open top and bottom. The elements 14 are permanently fixed to opposed walls of the dam member by any suitable means.

In use, as illustrated showing only one dam member in FIG. 2, the material to be treated is covered by a plurality of dam members 10 which are arranged in side by side and end to end juxtaposition. The dam members, as shown in the drawings, are embedded to a predetermined depth in the material. If, however, as will generally be the case, the surface material is sufficiently consolidated to inhibit easy penetration of the elements of the dam members the surface layer of the material 18 is loosened to a predetermined depth and the dam members then located on and in the surface material. In the FIG. 1 embodiment of the apparatus the partitioning elements 14 could include inwardly directed flanges, not shown, to limit the depth of penetration of the dam member into the particulate material of the slope.

When the dam members are located in position on the slope the compartments 16 are filled, as illustrated by dotted lines in FIG. 2, with a suitable liquid binding or sealing agent for consolidating the surface particles of the slope. A suitable sealing material for the purpose is a solution in water of sodium silicate used in conjunction with a gelling reactant such as aluminium sulphate or calcium chloride. Where the sloping material is being prepared for vegetation the binding liquid solution may include a suitable fertilizer.

The liquid trapped in the compartments obviously cannot migrate from the compartments other than through the particulate material below the embedded lower edges of the dam members and saturation of the surface material is thus ensured by the method of the invention. When the treated surface material has set sufficiently the dam members 10 are removed for re-use elsewhere.

Figure 3:
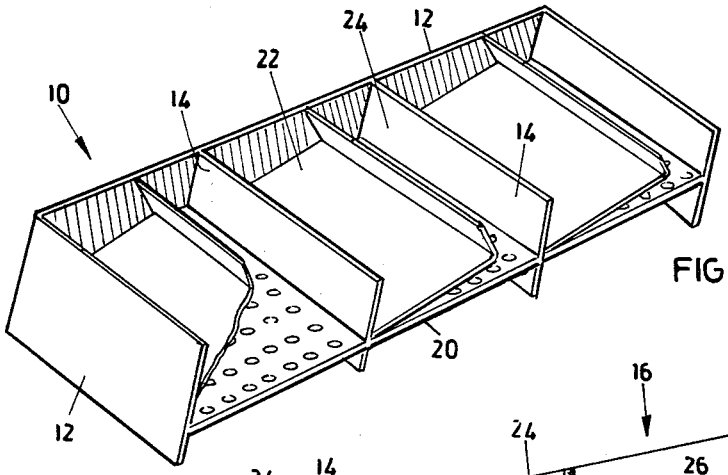
FIG. 3 is a sectioned perspective view of a second embodiment of the apparatus of the invention.
Figure 4:
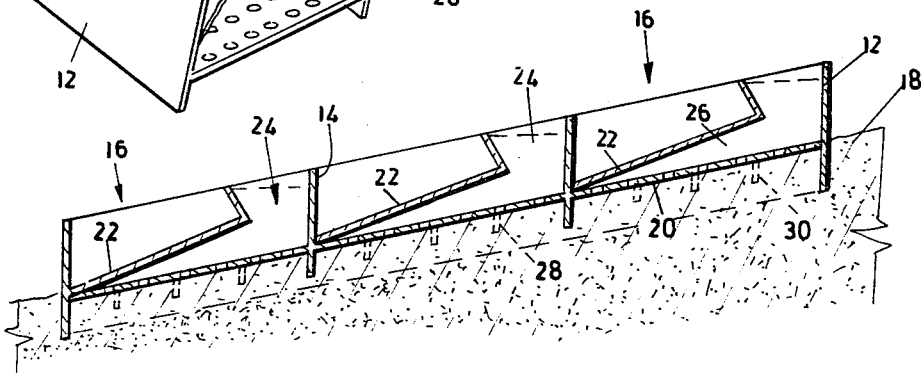
FIG. 4 is a sectioned side elevation of the apparatus of FIG. 3 in use.

The dam member of the invention illustrated in FIGS. 3 and 4 is shown to include basically the same elements as that of the FIG. 1 embodiment and in addition holed floor members 20 which span the compartments 16 intermediate the upper and lower edges of the wall and partition elements 12 and 14 and baffle plates 22 which taper from a trough shaped opening 24 at the up slope ends of the compartments downwardly towards the junction between the baffle plates and floor members 20. The baffle plate in the lower compartment in FIG. 3 has been broken away more clearly to illustrate the floor member 20. The partitioning elements 14 are angled relatively to the floor members to facilitate vertical penetration of the elements below the floor members. The height of the chambers formed between floor members and baffles 22 is exaggerated in the drawings for clarity of illustration.

This embodiment of the dam member is used in the same manner as that of the FIG. 1 embodiment. It is, however, more suitable for use on steep slopes and the bleed rate and spread of liquid from the compartments is more controlled than with the dam member of FIG. 1. As is seen in FIG. 4 the floor members 20 of the dam members of this embodiment limit the degree of penetration of the wall and partition elements into the loosened surface material 18 of the slope.

The dam member of FIGS. 3 and 4 finds particular application when used in soils and material having good to moderate liquid absorption capabilities. However, when used on consolidated mining slimes and other materials which have low absorption rates it may be, and probably is, necessary for the dam members to include spaced secondary dam members 28, as indicated in dotted lines in FIG. 4. The secondary members are suitably spaced, attached to the underside of the floor members and extend over the length of the compartments 16. The performance of the dam member is further improved in low permeability sloping material by making the upper-most secondary dam members 30 slightly longer than the members 28.

As an example only, approximate suitable dimensions for the FIGS. 3 and 4 embodiment of the dam member when used on a 30° slope have been found in practice to be:

(a) Distance separating the partitioning elements 14, about 150 mm.

(b) compartment length, about 450 mm.

(c) chamber 26 height, tapering from about 2 to 1 mm, (d) diameter of holes in floor members 20, about 3 mm diameter, (e) spacing of holes in the floor members 20, between 10 and 15 mm.

(f) distance by which partitioning members 14, project downwardly below the floor members 20 about 50 mm, (g) distance by which the side walls 12, project downwardly below the floor members 20, about 100 mm, (h) projecting distance of secondary dam member 28, about 25 mm, (i) projecting distance of secondary dam member 30, about 50 mm.

In use, the required amount of stabilising liquid is poured into each of the troughs 24 thus filling tapering chambers 26 between the baffle plates 22 and the floor members 20.

When the dam members of the invention are removed from site grooves will be left in the treated surface of the particulate material. The grooves may be filled in various ways such as, for example, by sprinkling particulate material in the grooves and then soaking the loose material with the liquid sealing material, by light spraying with the sealing liquid to dislodge sufficient treated material and cause it to gravitate into the grooves or by light trowelling.

If the particulate material is to be vegetated seeds may be planted in the grooves before they are filled in.

The invention is not limited to the precise constructional details or method of use as herein described. For example the dam member illustrated in FIGS. 1 and 2 could include sloping end walls and partitions 14, and floor members 20 as illustrated in the FIGS. 3 and 4 embodiment and the lower edges of all of the dam elements could be sharpened to facilitate penetration into the material 18. Additionally, the dam members need not be square or rectangular in plan but could be suitably shaped for location on the sloping corners of mine dumps or the like.

A further use for apparatus and method of the invention is in the application of water without the sealant or water including fertilizer only to areas of particulate material on which the water would otherwise run-off before penetration.

I claim:

1. Apparatus for use in stabilizing a surface layer of a body of particulate material comprising a horizontally-extending surface wall structure which extends along the top surface of said surface layer and which is constructed to permit liquid to flow vertically into said surface layer, and a vertically-extending wall structure which is formed by upper wall portions and lower wall portions, said upper wall portions forming a open-topped compartment positioned above said surface wall structure and adapted to receive liquid from above and to prevent the liquid from flowing a substantial distance horizontally, whereby the liquid is held in said compartment while it passes through said surface wall structure into said surface layer, said lower wall portions extending into said surface layer and diverting liquid downwardly in said surface layer.

2. Apparatus for use in stabilizing a surface layer of particulate material including a dam member comprising a continuous wall of sheet material which defines an enclosure which is open at its top and bottom, a floor member spanning said enclosure intermediate the top and bottom edges of said wall, a plurality of members which are upstanding from said floor member and which define a plurality of open-topped compartments above said floor member and a plurality of liquid-damming members extending across said wall and projecting downwardly from the underside of said floor member to arrest liquid flow beneath said floor member in a direction parallel to said floor member to a predetermined depth below said floor member when said floor member is resting on said particulate material to be stabilized.

3. Apparatus as claimed in claim 2 in which said liquid-damming members are strips of sheet material which are arranged parallel to each other and which extend between said enclosure walls on the underside of said floor member.

4. Apparatus as claimed in claim 2 in which said compartments are partially closed from a common direction above said floor by baffle members to prevent liquid spillage from the compartments when the dam member is inclined to the horizontal.

5. Apparatus as claimed in claim 4 in which said baffle members slope relatively to said floor member from the closed ends of the compartments upwardly towards the openings to the compartments.

* * * * *